US011926936B2

(12) United States Patent
Lawrence

(10) Patent No.: US 11,926,936 B2
(45) Date of Patent: Mar. 12, 2024

(54) DUAL FUNCTIONAL SPUN + FILAMENT FIBER WOVEN TERRY COOLING TOWEL

(71) Applicant: MPUSA, LLC, Fort Lauderdale, FL (US)

(72) Inventor: David Chad Lawrence, Atlanta, GA (US)

(73) Assignee: MPUSA, LLC, Fort Lauderdale, FL (US)

( * ) Notice: Subject to any disclaimer, the term of this patent is extended or adjusted under 35 U.S.C. 154(b) by 144 days.

(21) Appl. No.: 16/749,016

(22) Filed: Jan. 22, 2020

(65) Prior Publication Data

US 2020/0232128 A1 Jul. 23, 2020

Related U.S. Application Data

(60) Provisional application No. 62/795,211, filed on Jan. 22, 2019.

(51) Int. Cl.

| | |
|---|---|
| ***D03D 15/43*** | (2021.01) |
| ***D03D 15/47*** | (2021.01) |
| ***D03D 27/08*** | (2006.01) |
| *D03D 1/00* | (2006.01) |

(52) U.S. Cl.

CPC ..... *D03D 27/08* (2013.01); *D03D 15/47* (2021.01); *D10B 2201/02* (2013.01); *D10B 2331/06* (2013.01)

(58) Field of Classification Search

CPC ..... D03D 27/08; D03D 15/47; D03D 1/0017; D10B 2201/02; D10B 2331/06; D10B 2201/24; D10B 2331/02; D10B 2331/04

See application file for complete search history.

(56) References Cited

U.S. PATENT DOCUMENTS 1,739,205 A * 12/1929 Blanchard ..... D03D 27/08 139/25
1,766,805 A * 6/1930 Wakefield ..... D03D 27/08 139/396
3,721,273 A 3/1973 Sherrill et al.

(Continued)

FOREIGN PATENT DOCUMENTS

CN 2252820 Y 4/1997
CN 204198968 U 3/2015

(Continued)

OTHER PUBLICATIONS

International Search Report and Written Opinion issued in corresponding International Application No. PCT/US20/14529, dated Apr. 9, 2020, pp. 1-9.

(Continued)

*Primary Examiner* — Robert H Muromoto, Jr.
(74) *Attorney, Agent, or Firm* — CARTER, DELUCA & FARRELL LLP

(57) ABSTRACT

A terry fabric includes a first side configured to exhibit absorbency capabilities and a second side configured to exhibit cooling capabilities. The first side can include a spun fiber loop including a plurality of pile warp yarn, and the second side can include a plurality of weft yarn and a plurality of ground warp yarn, wherein at least one of the plurality of weft yarn and the plurality of ground warp yarn includes synthetic filament yarn.

18 Claims, 5 Drawing Sheets

300

(56) References Cited

U.S. PATENT DOCUMENTS

| | | | | |
|---|---|---|---|---|
| 4,860,530 | A * | 8/1989 | Montgomery | D02G 3/443 57/352 |
| 6,158,253 | A * | 12/2000 | Svoboda | D04B 1/106 66/178 R |
| 6,546,965 | B2 * | 4/2003 | Hamby | D02G 3/346 139/1 R |
| 6,666,234 | B2 * | 12/2003 | Hamby | D02G 3/346 139/396 |
| 7,044,173 | B2 | 5/2006 | Silver | |
| 7,300,692 | B2 | 11/2007 | Hirota et al. | |
| 9,534,323 | B1 | 1/2017 | Dubey et al. | |
| 10,072,364 | B2 * | 9/2018 | Goenka | D03D 27/08 |
| 10,145,035 | B2 * | 12/2018 | Goldberg | D03D 1/0017 |
| 10,167,579 | B2 | 1/2019 | Kilickan et al. | |
| 10,760,189 | B2 * | 9/2020 | Parker | D03D 15/513 |
| 11,015,271 | B2 * | 5/2021 | Lawrence | D02G 3/045 |
| 2002/0079014 | A1 * | 6/2002 | Hamby | D02G 3/346 139/396 |
| 2003/0084954 | A1 * | 5/2003 | Hamby | D03D 27/08 139/396 |
| 2004/0128811 | A1 * | 7/2004 | Mandawewala | D06C 23/00 28/168 |
| 2004/0131821 | A1 * | 7/2004 | Mandawewala | D03D 15/68 428/97 |
| 2005/0081939 | A1 | 4/2005 | Heiman | |
| 2008/0230140 | A1 | 9/2008 | Santens | |
| 2012/0076971 | A1 * | 3/2012 | Debnath | D03D 15/68 428/85 |
| 2013/0040523 | A1 * | 2/2013 | Takahashi | D02G 3/28 442/190 |
| 2015/0167210 | A1 * | 6/2015 | Tomlin | D02G 3/04 139/420 R |
| 2016/0333506 | A1 * | 11/2016 | Goenka | D03D 15/47 |
| 2017/0035602 | A1 * | 2/2017 | Shapiro | A61F 7/007 |
| 2017/0044695 | A1 * | 2/2017 | Hays | B32B 5/026 |
| 2017/0049397 | A1 * | 2/2017 | Sun | A61B 5/01 |
| 2017/0088984 | A1 | 3/2017 | Stewart | |
| 2017/0145596 | A1 * | 5/2017 | Hays | A47G 9/0246 |
| 2018/0034708 | A1 | 2/2018 | Nakajima et al. | |
| 2018/0179670 | A1 * | 6/2018 | Ito | D01F 6/66 |
| 2018/0266022 | A1 * | 9/2018 | Mandawewala | D02G 3/44 |
| 2018/0347084 | A1 | 12/2018 | Lawrence | |
| 2019/0239586 | A1 * | 8/2019 | Cui | D01F 1/10 |
| 2019/0254361 | A1 * | 8/2019 | Gorissen | B32B 7/022 |
| 2019/0316292 | A1 * | 10/2019 | Wu | A61B 5/01 |
| 2021/0219634 | A1 * | 7/2021 | Rykaczewski | A42B 1/008 |
| 2021/0277553 | A1 * | 9/2021 | Lawrence | D04B 21/04 |

FOREIGN PATENT DOCUMENTS

| | | | | |
|---|---|---|---|---|
| CN | 107059216 | A | 8/2017 | |
| CN | 108024670 | A | 5/2018 | |
| JP | 62-166282 | U | 10/1987 | |
| JP | H07-70875 | A | 3/1995 | |
| JP | 3066554 | U | 2/2000 | |
| JP | 2004-341209 | A | 12/2004 | |
| WO | WO-2006082725 | A1 * | 8/2006 | A47G 9/0238 |
| WO | 2011/141156 | A1 | 11/2011 | |
| WO | 2016/103281 | A1 | 6/2016 | |
| WO | WO-2018182567 | A1 * | 10/2018 | D03D 15/0027 |

OTHER PUBLICATIONS

Yilmaz, N.D. et al., "The Technology of Terry Towel Production" Journal of Textile and Apparel, Technology and Management (Summer 2005) pp. 1-46, vol. 4, issue 4.

International Preliminary Report on Patentability issued in corresponding International Application No. PCT/US20/14529, dated Jul. 27, 2021, pp. 1-7.

Chinese Office Action issued in corresponding CN Patent Application No. 202080016066.3, dated Aug. 23, 2022, pp. 1-15, together with English translation.

Extended European Search Report issued in corresponding EP Patent Application No. 20744880.4 dated Oct. 14, 2022, pp. 1-9.

Second Office Action issued in corresponding Chinese Patent Application No. 202080016066.3, dated Feb. 4, 2023, pp. 1-7, with English Translation.

Third Office Action issued in corresponding Chinese Patent Application No. 202080016066.3, dated Apr. 28, 2023, pp. 1-13, with English Translation.

Office Action issued in corresponding Brazilian Patent Application No. BR112021014464-1, dated Nov. 7, 2023, pp. 1-7, with English Translation.

Notice of Reasons for Rejection issued by the Japanese Patent Office dated Jan. 9, 2024 in corresponding JP Patent Application No. 2021-543469, with English translation.

* cited by examiner

100

200

DUAL FUNCTIONAL SPUN + FILAMENT FIBER WOVEN TERRY COOLING TOWEL

CROSS-REFERENCE TO RELATED APPLICATION

This application claims the benefit of the filing date of, and incorporates by reference thereto in its entirety, U.S. Provisional Patent Application Ser. No. 62/795,211, filed on Jan. 22, 2019.

TECHNICAL FIELD

The present application relates to a dual function, multi-layer terry fabric.

BACKGROUND

Terry fabrics get their name from the weaving method used to create the fabrics, i.e., terry weaving. Terry fabrics, such as terry towels, generally correspond to warp pile fabrics including uncut pile loops on either side of the fabric. The pile loops on either side of the fabric can be used for absorbing liquids (e.g., water). As such, a terry fabric can be used for bathing and/or exercise activities in order to absorb excess water and/or sweat. However, because such fabrics are generally comprised of 100% cotton, they have a diminished evaporative cooling ability. Further, although synthetic-based fabrics have an improved evaporative cooling ability over the cotton-based fabrics, the synthetic-based fabrics are not as effective as absorbing liquid as the cotton-based fabrics.

Accordingly, there is a need for a solution which can overcome at least some of the deficiencies described herein above.

SUMMARY OF THE INVENTION

According to an embodiment, the invention relates to a terry fabric including a first side configured to exhibit absorbency capabilities and a second side configured to exhibit cooling capabilities. According to an embodiment, the first side can include a spun fiber loop including a plurality of pile warp yarn, and the second side can include a plurality of weft yarn and a plurality of ground warp yarn, wherein at least one of the plurality of weft yarn and the plurality of ground warp yarn includes synthetic filament yarn (and/or synthetic spun yarn).

DESCRIPTION OF EMBODIMENTS

Figure 1:
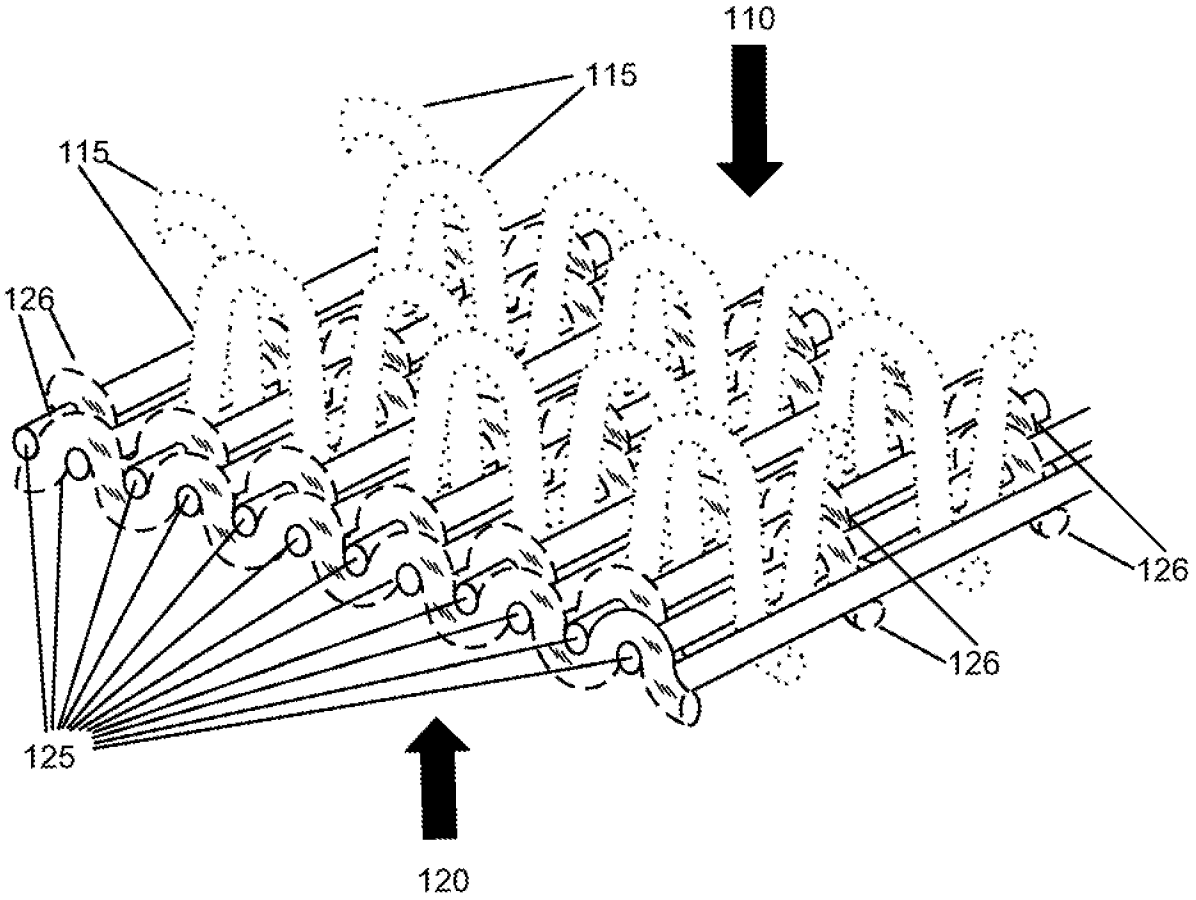
FIG. 1 illustrates a cross-sectional view of the improved terry fabric according to an exemplary embodiment of the invention.

The following description of embodiments provides non-limiting representative examples referencing numerals to particularly describe features and teachings of different aspects of the invention. The embodiments described should be recognized as capable of implementation separately, or in combination, with other embodiments from the description of the embodiments. A person of ordinary skill in the art reviewing the description of embodiments should be able to learn and understand the different described aspects of the invention. The description of embodiments should facilitate understanding of the invention to such an extent that other implementations, not specifically covered but within the knowledge of a person of skill in the art having read the description of embodiments, would be understood to be consistent with an application of the invention.

According to an embodiment, evaporative cooling performance can be added to a cotton-based terry fabric (e.g., towel) by inserting synthetic filament yarn (polyester or nylon-based) during the weaving process. Terry fabrics are generally comprised of 100% cotton or chief-value cotton (CVC) (i.e., greater than 50% cotton) and normally weigh between 340 to 370 grams per square meter (gsm). After a synthetic filament yarn is inserted, the improved terry fabric is capable of absorbing over four times its weight in liquid (e.g., sweat or water) on a loop side of the fabric, while also being able to conductively cool a person's skin on the flat, non-loop side, over 20 degrees Fahrenheit below a person's average core body temperature (e.g., in moderately warm weather conditions), as well as over 10,000 cumulative watts of cooling power after wet activation. According to an embodiment, the improved terry fabric can be comprised of a combination of synthetic and cotton yarn, which can respectively correspond to at least one of ground, pile, and weft yarn.

According to an embodiment, one side of the improved terry fabric is configured to be exhibit absorbency capabilities. This side can include a raised loop with a cotton pile height of greater than 0.5 millimeters on the loop side. The raised loop can be altered to other lengths depending on the amount of absorbency and weight desired. Further, the other side of the terry fabric is configured to exhibit cooling capabilities. This other side can include synthetic filament yarn configured to impart extra evaporative cooling performance to impart a cooling sensation to the user(s).

According to an embodiment, the wet-pick-up percentage (WPU %) of the improved terry fabric can be greater than 400% (or four times) of the weight of the fabric. Further, the improved terry fabric can generate a cumulative cooling power of greater than 10,000 $W/m^2$ (watts per square meter) and can display a maximum interval watts per square meter (heat flux) output at one peak per minute of greater than 700 $w/m^2$, as measured on the non-loop side of the fabric. Further, according to an embodiment, the improved terry fabric can stay wet for a duration of greater than 10 hours.

Further, the unique combination of synthetic filament yarn and spun cellulosic and/or synthetic yarn is configured to add the cooling properties (e.g., maximum interval cooling power and cool touch) as well as moisture transport and evaporation. In particular, special modified cross-section synthetic filament yarn can be added to the construction to aid in the moisture transport and evaporation. These yarns can also contain embedded cooling particle technology (e.g., jade or mica) to increase the Q-max rating (instant cool touch) of the material on the non-loop side. In addition, conjugated yarn (e.g., polyester and nylon) with a modified pie-shaped cross-section can be added in place of spun fibers to improve moisture retention and evaporation.

According to an embodiment, cooling can be activated as follows: after the material is used to absorb undesirable sweat, the improved terry fabric can then be wetted, wringed, and snapped to create a cooling device providing cooling primarily on the non-loop side of the fabric. Further, in order to inhibit microbial growth, the terry fabric can be treated with antimicrobial chemistry or special yarn can be added to it, thereby making it odor-free after repeated usage and wash care. However, chemicals are not required for the cooling material to impart cooling ability. Further, the improved terry fabric is machine washable and dryable. In addition, the improved terry fabric has a cooler touch (or higher Q-max) due to the usage of cooling yarn (e.g., synthetic filament yarn) on the non-loop side of the material.

As such, with the improved terry fabric, a single material is able to provide both absorbing and cooling, e.g., one side is configured to absorb liquid/moisture for drying sweat or absorbing moisture, while the other side is configured to provide conductive cooling. For example, as described above, one side (e.g., non-loop cooling side) can consist of either predominately polyester or nylon yarn, which can consist of modified cross-section yarn and can include embedded particles (e.g., jade or mica) that help to transport and evaporate moisture while providing a cool touch. The opposite side (e.g., loop absorbing side) can consist of predominately cotton yarn, which enables the improved terry fabric to absorb and hold moisture.

In view of the above, the improved terry fabric can provide the following benefits: (i) dual functions of absorbency and conductive cooling, (ii) temperature decrease of 30 degrees below average core body temperature when wet after 5 minutes, and a decrease of 20 degrees below average skin temperature after just 2 minutes, as measured within a controlled conditioned laboratory, (iii) duration of cooling over 10 hours in a conditioned lab environment, (iv) the WPU % is over four times it's weight, which is significantly higher than existing cooling fabrics in the market, and (v) increased Q-max (cool touch) on the cooling non-loop side of the material.

FIG. 1 illustrates a cross-sectional view of the improved terry fabric according to an exemplary embodiment of the invention. According to an embodiment, an improved terry fabric 100 can include an absorbent side 110 and a cooling side 120. According to an embodiment, the absorbent side 110 can correspond to a spun fiber loop such as cotton (or a cotton/synthetic blend) comprising a plurality of pile warp yarn 115. Further, the cooling side 120 includes a plurality of weft yarn 125 and a plurality of ground warp yarn 126. According to an embodiment, the plurality of weft yarn 125 can be comprised of synthetic filament yarn, e.g., polyester or nylon-based. Similarly, the plurality of ground warp yarn 126 can also be comprised of synthetic filament yarn that are polyester or nylon-based. According to an embodiment, if the terry fabric 100 is a cotton/polyester blend, the blend should contain at least 10% polyester total. Further, if the terry fabric 100 is a cotton/nylon blend, the blend should contain at least 10% nylon total. Further, if the terry fabric 100 is a cotton/polyester/nylon blend, the blend should contain at least 10% nylon and 10% polyester total. Further, according to an embodiment, instead of cotton, other spun fiber can also be used in one of the above blends, such as Modal, Rayon, Bamboo from Rayon, Tencel, etc. In addition, a blend of cotton and at least one of the other spun fibers could also be used instead of cotton. Further, according to an embodiment, the terry fabric 100 can include a weight range of 160-700 gsm.

The cooling effect for the terry fabric 100 follows the principles of evaporative cooling. This principle details that water must have heat applied to change from a liquid to a vapor. Once evaporation occurs, this heat from the liquid water is taken due to evaporation resulting in cooler liquid. Once the terry fabric 100 is wetted with water and preferably wringed to remove excess water, snapping or twirling in the air is a recommended process as it helps facilitate and expedite the moisture movement from the absorbent side 110, where water is stored, to the cooling side 120, where water evaporation occurs. Snapping or twirling in the air also increases the evaporation rate and decreases the material temperature more rapidly by exposing more surface area of the material to air and increased air flow. More specifically, the terry fabric 100 functions as a device that facilitates and expedites the evaporative process.

Once the temperature of the remaining water in the cooling side 120 drops through evaporation, a heat exchange happens within water through convection, between water and fabric through conduction, and within fabric through conduction. Thus, the temperature of the terry fabric 100 drops. The evaporation process further continues by wicking water away from the absorbent side 110 to the cooling side 120 until the stored water is used up. The evaporation rate decreases as the temperature of terry fabric 100 drops. The temperature of the terry fabric 100 drops gradually to a certain point where equilibrium is reached between the rate of heat absorption into material from environment and heat release by evaporation.

Once the wetted terry fabric 100 is placed onto one's skin, cooling energy from the terry fabric 100 is transferred through conduction. After the cooling energy transfer has occurred, the temperature of the cooling fabric increases to equilibrate with the skin temperature. Once this occurs, the wetted terry fabric 100 can easily be re-activated by the snapping or the twirling method to again drop the temperature.

Figure 2:
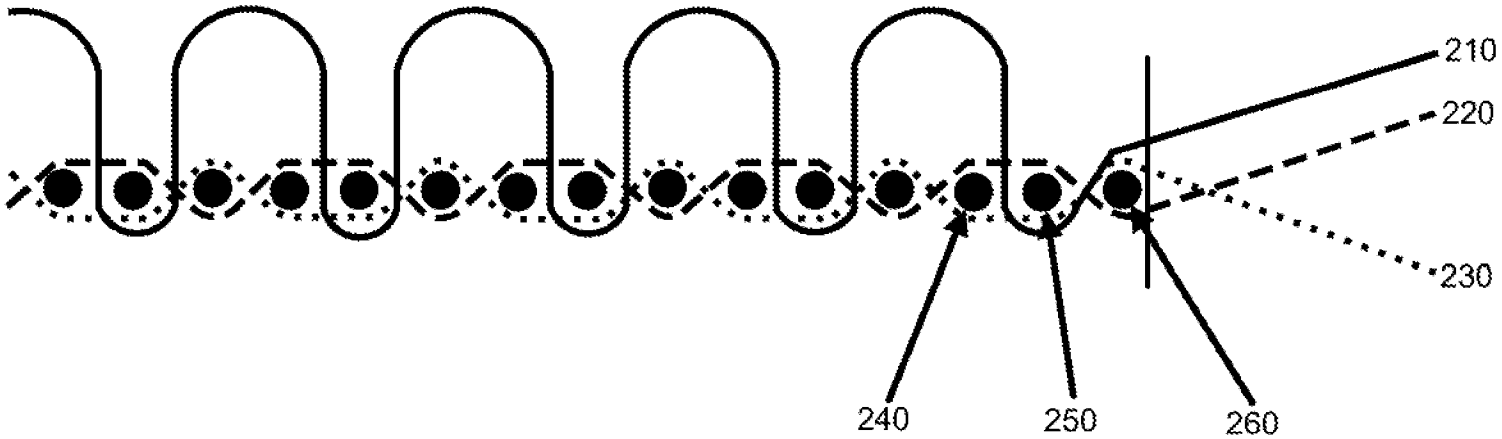
FIG. 2 illustrates a 3-pick woven terry with one pile loop according to an exemplary embodiment of the invention.

FIG. 2 illustrates a 3-pick woven terry with one pile loop according to an exemplary embodiment of the invention. According to an embodiment, a woven terry 200 includes a pile warp yarn 210, ground warp yarn 220 and 230, and weft yarn (i.e., picks) 240, 250, and 260. According to an embodiment, the front and back side pile warps 210 and first and second ground warps 220 and 230, respectively, can be utilized to form what is known as a 2/1 rib weave construction. In this weave construction, one pile warp 210 is one pick ahead of a ground warp (e.g., 220 or 230). For example, in a 1:1 warp order, each ground warp end is followed by a pile warp end, while, in a 2:2 warp order, two ground warp ends are followed by two pile warp ends. According to an embodiment, the figure depicts a 2:1 warp order between ground and pile warp ends. According to another embodiment, a 2:2 warp construction using pile yarns on only one side is also possible.

As depicted in Table 1 below, the woven terry 200 can be configured in a number of ways, where "C" corresponds to cotton or regenerated cellulosic spun fiber (where the fiber size ranges from 8 Ne (English Cotton Count) to 60 Ne (English Cotton Count), "S" corresponds to synthetic filament yarn (where the filament size ranges from 10 Denier to 300 Denier), "CS" corresponds to a cotton/synthetic blended spun fiber (where the fiber size ranges from 8 Ne to 60 Ne), and "SS" corresponds to synthetic spun fiber (where the fiber size ranges from 8 Ne to 60 Ne).

TABLE 1

| | Pile 1 (210) | Ground 1 (220) | Ground 2 (230) | 1st Pick (240) | 2nd Pick (250) | 3rd Pick (260) |
|---|---|---|---|---|---|---|
| Option 1 | C | SS | SS | S | S | S |
| Option 2 | C | C | C | S | S | S |
| Option 3 | C | CS | CS | S | S | S |
| Option 4 | CS | CS | CS | S | S | S |
| Option 5 | C | SS | SS | SS | SS | SS |
| Option 6 | SS | SS | SS | SS | SS | SS |
| Option 7 | SS | CS | CS | S | S | S |
| Option 8 | C | C | C | CS | CS | CS |
| Option 9 | C | C | C | SS | SS | SS |
| Option 10 | CS | SS | SS | S | S | S |
| Option 11 | CS | S | S | S | S | S |
| Option 12 | C | S | S | SS | SS | SS |
| Option 13 | C | S | S | CS | CS | CS |
| Option 14 | CS | S | S | SS | SS | SS |

According to an embodiment, S can be one of polyester, nylon, and a polyester/nylon blend. Similarly, SS can also be one of polyester, nylon, and a polyester/nylon blend. Further, CS can be one of a cotton/polyester blend, a cotton/nylon blend, a cotton/polyester/nylon blend, a cotton/Modal blend, a cotton/Tencel blend, a cotton/rayon blend, and a cotton/Viscose blend. According to an embodiment, other combinations of yarn for the woven terry 200 can also be included. For example, Pile 1 can be SS, Grounds 1 and 2 can be SS, and the 1st, 2nd, and 3rd Picks are S.

Figure 3:
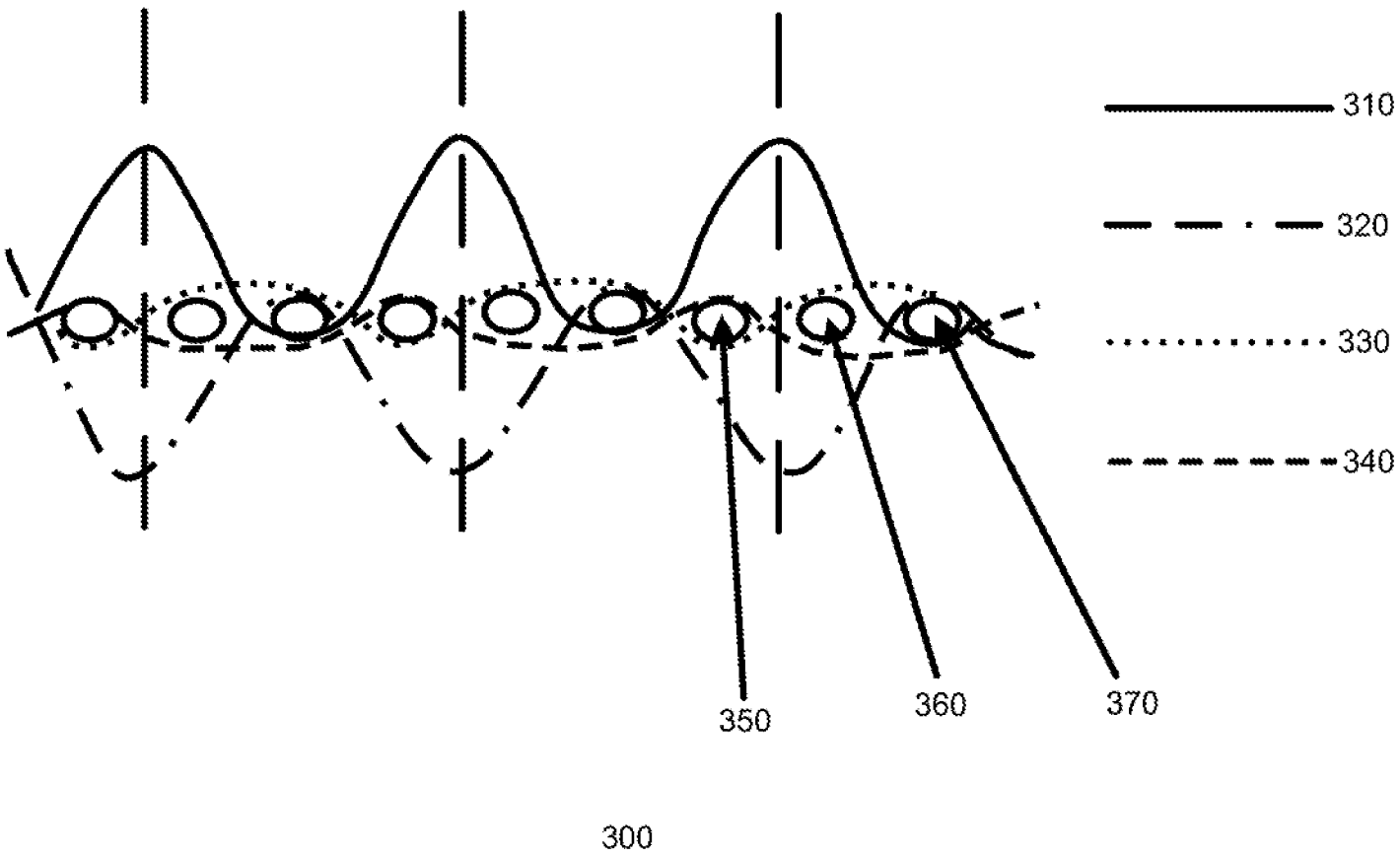
FIG. 3 illustrates a 3-pick woven terry with two pile loops according to an exemplary embodiment of the invention.

FIG. 3 illustrates a 3-pick woven terry with two pile loops according to an exemplary embodiment of the invention. According to an embodiment, a woven terry 300 includes a pile warp yarn 310 and 320, ground warp yarn 330 and 340, and weft yarn (i.e., picks) 350, 360, and 370. According to an embodiment, the weave construction in FIG. 3 is similar to the weave construction in FIG. 2 except that the pile warp ends alternate to two separate sides, e.g., front and back, in FIG. 3. According to an embodiment, the pile height of a pile warp end on one side is greater than the pile height of the pile warp end on the other side. In particular, the pile height of the shorter pile warp end can be less than 0.5 mm. In this regard, the side with the greater pile height can be used for absorbing, while the side with the shorter pile height can be used to provide more evaporative cooling (e.g., since more evaporative cooling yarn is being added with the pile warp ends).

As depicted in Table 2 below, the woven terry 200 can be configured in a number of ways.

TABLE 2

| | Front Pile (310) | Back Pile (320) | Ground 1 (330) | Ground 2 (340) | 1st Pick (350) | 2nd Pick (360) | 3rd Pick (370) |
|---|---|---|---|---|---|---|---|
| Option 1 | C | S or SS | SS | SS | S | S | S |
| Option 2 | C | S or SS | C | C | S | S | S |
| Option 3 | C | S or SS | CS | CS | S | S | S |
| Option 4 | CS | S or SS | CS | CS | S | S | S |
| Option 5 | C | S or SS | SS | SS | SS | SS | SS |
| Option 6 | SS | S or SS | SS | SS | SS | SS | SS |
| Option 7 | SS | S or SS | CS | CS | S | S | S |
| Option 8 | C | S or SS | C | C | CS | CS | CS |
| Option 9 | C | S or SS | C | C | SS | SS | SS |
| Option 10 | CS | S or SS | SS | SS | S | S | S |
| Option 11 | CS | S or SS | S | S | S | S | S |
| Option 12 | C | S or SS | S | S | SS | SS | SS |
| Option 13 | C | S or SS | S | S | CS | CS | CS |
| Option 14 | CS | S or SS | S | S | SS | SS | SS |

Figure 4B:
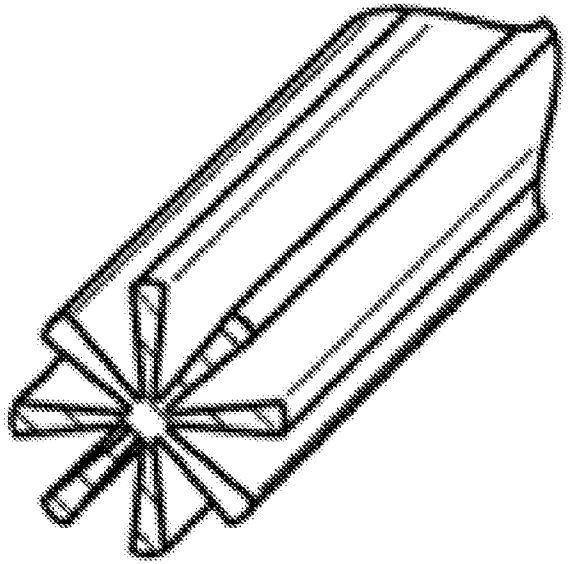
FIGS. 4A-4B illustrates cross-sectional views of synthetic filament yarn according to exemplary embodiments of the invention.
Figure 4A:
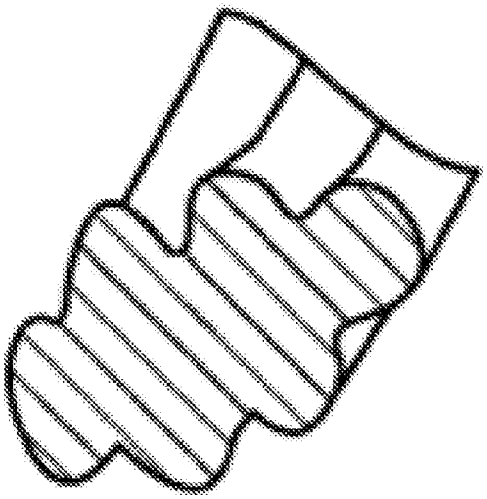

FIGS. 4A-4B illustrates cross-sectional views of synthetic filament yarn according to exemplary embodiments of the invention. For example, FIG. 4A depicts a synthetic filament yarn (e.g., polyester and/or nylon) having a unique cross section. According to an embodiment, the unique cross section creates channels in the yarn for moisture to move and evaporate more quickly. As such, the synthetic filament yarn in FIG. 4A can be implemented by the cooling side 120 of the terry fabric 100. Further, FIG. 4B depicts a synthetic filament yarn having a star-shaped cross section. In this regard, the star-shaped cross section provides a higher absorbency and, therefore, holds water more efficiently. As such, the synthetic filament yarn in FIG. 4B can be implemented by absorbent side 110 of the terry fabric 100. According to an embodiment, a differentiated cross section helps moisture move and spread to the outer layer of the fabric. Further, the synthetic filament yarn can also include absorbent microdenier yarn. According to an embodiment, the absorbent microdenier yarn can be less than 1 denier per filament (dpf). Further, the absorbent microfiber yarn can uses multiple filaments (e.g., 72 filaments) to provide absorbent properties. Further, according to another embodiment, conjugated bi-component special cross-section yarn can be used to provide extreme absorbent properties. Further, by splitting the yarn, more surface area and, therefore, more pockets can be created for absorbency.

Figure 5A:
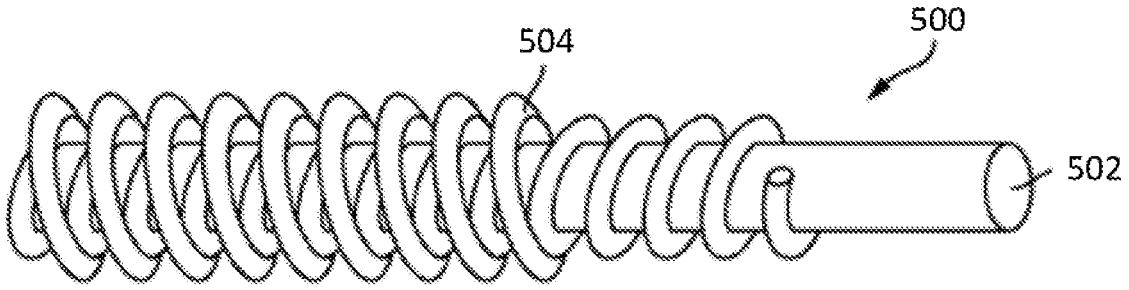
FIGS. 5A-5D illustrates covered synthetic filament yarn according to exemplary embodiments of the invention.
Figure 5B:
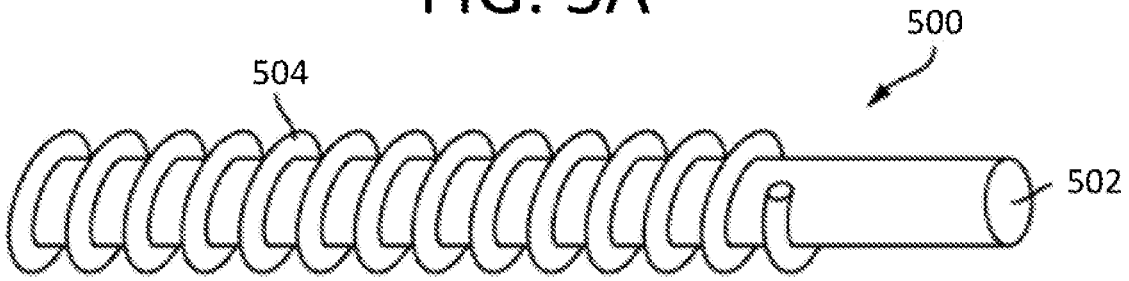
Figure 5C:
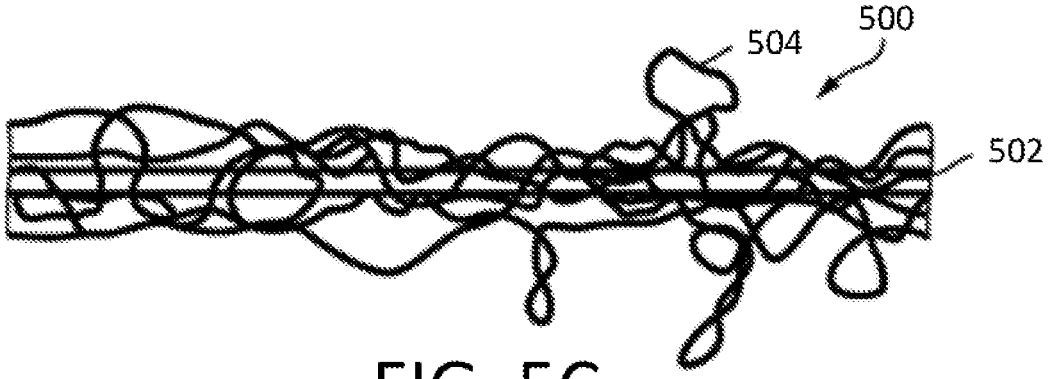
Figure 5D:
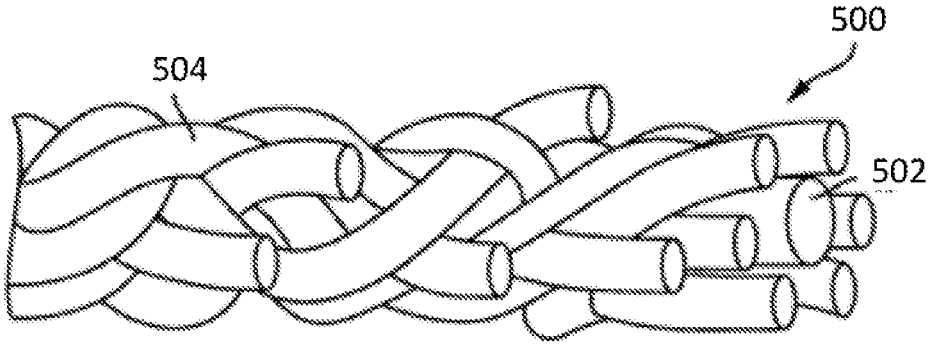

According to an embodiment, the synthetic filament yarn includes a thickness that is half the thickness of a cotton yarn. As such, in order to balance the thickness of the cotton yarn, two ends of the synthetic filament yarn can be added instead of one. This can be achieved by covering a predominately synthetic spun or filament yarn with another synthetic yarn filament. FIGS. 5A-5D illustrates covered synthetic filament yarn according to exemplary embodiments of the invention. For example, FIG. 5A illustrates a double-covered synthetic filament yarn. In particular, FIG. 5A depicts a covered synthetic filament yarn 500 including a core predominately synthetic spun or filament yarn 502 being covered by another synthetic filament yarn 504 in a double-covered manner. FIG. 5B illustrates a single-covered synthetic filament yarn. In this regard, FIG. 5B depicts the core predominately synthetic spun or filament yarn 502 being covered by another synthetic filament yarn 504 in a single-covered manner. Further, FIG. 5C illustrates an air jet-covered synthetic filament yarn. In this regard, FIG. 5B depicts the core predominately synthetic spun or filament yarn 502 being covered by another synthetic filament yarn 504 via air jet covering technique. Lastly, FIG. 5D illustrates a core-spun synthetic filament yarn. In this regard, the core predominately synthetic spun or filament yarn 502 is wrapped with other synthetic filament yarn 504 and spun into a single yarn 500. The list in Table 3 below describes possible combinations of a core synthetic filament yarn 502 and another synthetic filament yarn 504.

TABLE 3

| Core Yarn | Covered Yarn | Total Estimated Denier |
|---|---|---|
| 30 Ne 80% Polyester/20% Tencel Spun Yarn Blend | Synthetic Filament Evaporative Cooling Polyester 150 Denier/72 Filaments Draw Textured Yarn (DTY) | 327 Denier Total (Single covered) |
| 30 Ne 80% Polyester/20% Tencel Spun Yarn Blend | Synthetic Filament Evaporative Cooling Polyester 2 ply/70 Denier/26 Filament Fully Drawn Yarn (FDY) | 317 Denier total (Single covered yarn) |
| 30 Ne 80% Polyester/20% Tencel Spun Yarn Blend | Synthetic Filament Evaporative Cooling Nylon 140 Denier/136 Filament Draw Textured Yarn (DTY) | 317 Denier total (Single covered yarn) |
| 30 Ne 80% Polyester/20% Tencel Spun Yarn Blend | Synthetic Filament Evaporative Cooling Nylon 2 ply/70 Denier/48 Filament Fully Drawn Yarn (FDY) | 317 Denier total (Single covered yarn) |

According to an embodiment, by increasing the thickness of the synthetic filament yarn not only does the weight of the synthetic filament yarn balance the weight of the cotton, but the cooling intensity of the overall terry fabric increases as well.

Further, according to an embodiment, although the invention has been described in relation to a 3-pick terry construction, it can also be implemented in a 2, 3, 4, 5, or even more pick terry construction. In this regard, the invention can be implemented in any fabric utilizing a terry construction.

In the foregoing Description of Embodiments, various features may be grouped together in a single embodiment for purposes of streamlining the disclosure. This method of disclosure is not to be interpreted as reflecting an intention that the claims require more features than are expressly recited in each claim. Rather, as the following claims reflect, inventive aspects lie in less than all features of a single foregoing disclosed embodiment. Thus, the following claims are hereby incorporated into this Description of Embodiments, with each claim standing on its own as a separate embodiment of the invention.

Moreover, it will be apparent to those skilled in the art from consideration of the specification and practice of the present disclosure that various modifications and variations can be made to the disclosed systems without departing from the scope of the disclosure, as claimed. Thus, it is intended that the specification and examples be considered as exemplary only, with a true scope of the present disclosure being indicated by the following claims and their equivalents.

The invention claimed is:

1. A terry fabric, the fabric comprising:

a first side, arranged as an absorbent side, wherein the first side includes a spun fiber loop including a plurality of pile warp yarn; and a second side, arranged as a cooling side, wherein the second side includes a plurality of weft yarn and a plurality of ground warp yarn, wherein at least one of the plurality of weft yarn and the plurality of ground warp yarn includes a covered yarn having a synthetic spun and/or filament yarn core covered by at least one other synthetic filament yarn;

wherein the second side includes a plurality of pile warp yarn; and wherein a pile height of a pile warp end on a first one of the first side and the second side is less than 0.5 mm and a pile height of a pile warp end on a second one of the first side and the second side is greater than the pile height of the pile warp end on the first one of the first side and the second side;

wherein the first side is adapted to provide greater moisture absorbency than the second side; and wherein the second side is adapted to provide greater evaporative cooling than the first side.

2. The fabric according to claim 1, wherein the spun fiber loop udes one of cotton and a cotton/synthetic filament yarn blend.

3. The fabric according to claim 2, wherein the cotton is chief-value cotton.

4. The fabric according to claim 2, wherein the cotton/synthetic filament yarn blend is one of a cotton/polyester blend, a cotton/nylon blend, a cotton/polyester/nylon blend.

5. The fabric according to claim 1, wherein the synthetic filament yarn is one of polyester, nylon, and a polyester/nylon blend.

6. The fabric according to claim 1, wherein the first side includes one pile loop.

7. The fabric according to claim 1, further comprising two pile loops.

8. The fabric according to claim 1, wherein the at least one other synthetic filament yarn covers the core via one of a single-covered manner, a double-covered manner, and an air jet covering technique.

9. The fabric according to claim 1, wherein the core is wrapped with the at least one other synthetic filament yarn and spun to create a single yarn.

10. The fabric according to claim 1, wherein a pile height of the spun fiber loop is greater than 0.5 mm.

11. The fabric according to claim 1, wherein the fabric is associated with a heat flux of at least 10,000 cumulative watts per square meter.

12. The fabric according to claim 1, wherein the fabric is comprised of at least 10% synthetic filament yarn.

13. The fabric according to claim 1, wherein the first side is configured to absorb at least four times the fabric's weight in liquid.

14. The fabric according to claim 1, wherein the plurality of pile warp yarn, the plurality of weft yarn, and the plurality of ground warp yarn are implemented in a 3-pick terry construction.

15. The fabric according to claim 1, wherein the plurality of ground warp yarn includes synthetic spun yarn.

16. The fabric according to claim 1, wherein at least one of the plurality of weft yarn includes synthetic filament yarn and at least one of the plurality of ground warp yarn includes synthetic filament yarn.

17. The fabric according to claim 1, wherein the covered yarn is arranged as a single-covered yarn, a double-covered yarn, and/or an air jet-covered yarn.

18. The fabric according to claim 1, wherein the covered yarn is arranged as a core-spun synthetic filament yarn.

* * * * *